US011101084B2

(12) United States Patent
Thizon et al.

(10) Patent No.: US 11,101,084 B2
(45) Date of Patent: Aug. 24, 2021

(54) SWITCHING ASSEMBLY WITH SECURE ATTACHMENT SOLUTION FOR EMERGENCY STOP DEVICE

(71) Applicant: Schneider Electric Industries SAS, Rueil-Malmaison (FR)

(72) Inventors: Patrice Thizon, Ruelle sur Touvre (FR); Eric Perard, Puymoyen (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/660,399

(22) Filed: Oct. 22, 2019

(65) Prior Publication Data

US 2020/0144005 A1 May 7, 2020

(30) Foreign Application Priority Data

Nov. 7, 2018 (FR) ..... 1860252

(51) Int. Cl.
*H01H 13/20* (2006.01)
*H01H 13/04* (2006.01)
*H01H 13/14* (2006.01)

(52) U.S. Cl.
CPC ..... *H01H 13/20* (2013.01); *H01H 13/04* (2013.01); *H01H 13/14* (2013.01); *H01H 2235/01* (2013.01)

(58) Field of Classification Search
CPC ..... H01H 13/14; H01H 13/18; H01H 13/12; H01H 13/10; H01H 13/186; H01H 13/183;

(Continued)

(56) References Cited

U.S. PATENT DOCUMENTS 4,284,864 A * 8/1981 Crow ..... H01H 35/10 200/537
4,764,649 A * 8/1988 Sakai ..... H01H 13/36 200/412

(Continued)

FOREIGN PATENT DOCUMENTS

DE 4101493 7/1992
DE 102007047293 4/2009

(Continued)

OTHER PUBLICATIONS

French Preliminary Search Report and Written Opinion for French Patent Application Publication No. FR1860252, dated Jul. 16, 2019, 8 pages.

(Continued)

*Primary Examiner* — Ahmed M Saeed
(74) *Attorney, Agent, or Firm* — Locke Lord LLP

(57) ABSTRACT

A switching assembly intended to be joined onto a control assembly provided with an actuation member, the switching assembly comprising a body, an electrical circuit comprising two fixed contacts, the electrical circuit being able to be controlled both by a control switch of a normally-closed type and by a monitoring switch of a normally-open type, linked in series with the control switch. The monitoring switch makes it possible to monitor the correct secure attachment of the switching assembly onto the control (Continued)

B2-B2 assembly by keeping the electrical circuit open as long as the control assembly is mechanically disconnected from the switching assembly.

12 Claims, 5 Drawing Sheets

(58) Field of Classification Search
CPC ..... H01H 3/022; H01H 13/02; H01H 13/503; H01H 13/48; H01H 13/62; H01H 13/66; H01H 13/70; H01H 13/807; H01H 13/506; H01H 13/04; H01H 13/20; H01H 13/50
See application file for complete search history.

(56) References Cited

U.S. PATENT DOCUMENTS

| | | | | |
|---|---|---|---|---|
| 6,028,274 | A * | 2/2000 | Harris | H01H 3/001 200/16 B |
| 6,198,058 | B1 * | 3/2001 | Graninger | H01H 13/02 200/16 R |
| 8,497,438 | B2 * | 7/2013 | Chauvet | H01H 1/205 200/43.04 |
| 2008/0000760 | A1 | 1/2008 | Ng et al. | |

FOREIGN PATENT DOCUMENTS

| | | | |
|---|---|---|---|
| DE | 202017006762 | | 4/2018 |
| EP | 0089863 | | 9/1983 |
| EP | 2332158 | B1 | 7/2014 |
| EP | 2564408 | B1 | 12/2014 |
| WO | WO2011/135225 | | 11/2011 |

OTHER PUBLICATIONS

English Language Machine Translation of European Patent Publication No. EP0089863 dated Sep. 28, 1983, 8 pages.
English Language Machine Translation of German Patent Publication No. DE4101493 dated Jul. 23, 1992, 9 pages.
English Language Machine Translation of German Patent Publication No. DE102007047293 dated Apr. 9, 2009, 16 pages.
English Language Machine Translation of German Patent Publication No. 202017006762 dated Apr. 27, 2018, 15 pages.
English Language Machine Translation of Abstract of European Patent Publication No. EP2564408 dated Dec. 3 2014, 2 pages.
European Search Report for European Patent Application No. 19204028.5-1202 dated Apr. 7, 2020, 5 pages.

* cited by examiner

B3-B3

B2-B2

B3-B3

B2-B2

SWITCHING ASSEMBLY WITH SECURE ATTACHMENT SOLUTION FOR EMERGENCY STOP DEVICE

TECHNICAL FIELD OF THE INVENTION

The present invention relates to a switching assembly. The invention relates more particularly to a switching assembly intended to be joined onto a control assembly to form a switching device of emergency stop type.

STATE OF THE ART

As a general rule, an emergency stop device comprises a control assembly bearing an actuation member and a switching assembly also called contact block intended to be mounted behind the control assembly. The switching assembly comprises at least one main mobile bridge supporting mobile contacts actuated by the actuation member relative to fixed contacts from a closed position to an open position to open an electrical circuit in case of emergency. In an emergency stop device, the main contacts are therefore of normally-closed type.

When the device is mounted, the control assembly and the switching assembly are often mounted mechanically on either side of a wall. The switching assembly is therefore invisible to the user. It is therefore impossible for the user to know at all times whether the control assembly is correctly mounted on the switching assembly. Now, a detachment of one of the assemblies from the other means that the device can no longer operate correctly. Given that an emergency stop device is intended to apply a safety function, it is necessary for this device to operate correctly. For that, it is therefore essential to ensure that the switching assembly is correctly attached to the control assembly when the emergency stop device is required to operate.

Devices are known in particular from the U.S. Pat. No. 6,198,058 and DE4101493 that make it possible to monitor the attachment of the control assembly to the switching assembly. In these two patents, a set of normally-closed contacts and a set of normally-open contacts are placed in series on the electrical circuit to be controlled. As long as the switching assembly is disconnected mechanically from the control assembly, the normally-open contacts remain open and when the switching assembly is mounted on the control assembly, these normally-open contacts close. In normal operation, upon a pressure on the actuation member, the normally-closed contacts open.

Other solutions that make it possible to resolve the same technical problem are also described in the patents EP2332158B1 and EP2564408B1.

In the latter patent EP2564408B1, the switching assembly uses two nested pushbuttons and a mobile support with two independent connecting plates, each bearing a mobile control contact intended to cooperate with a fixed contact of the switching assembly and a detection contact. It also comprises a mobile bridge bearing two mobile detection contacts intended to come into contact with the detection contacts of the connecting plates to establish an electrical link between the two connecting plates when the control assembly and the switching assembly are operationally attached.

The aim of the invention is to propose a novel solution that makes it possible to ensure that the control assembly is correctly mounted on the switching assembly. This solution offers simple operation and is realized in a limited bulk.

SUMMARY OF THE INVENTION

This aim is achieved by a switching assembly intended to be joined onto a control assembly provided with an actuation member that can take an idle position and an actuation position, said switching assembly comprising:

A body, an electrical circuit comprising two fixed contacts, said electrical circuit being able to be controlled both by a control switch of normally-closed type comprising a first mobile contact bridge bearing a first mobile control contact and a second mobile control contact and by a monitoring switch of normally-open type, linked in series with said control switch and comprising a second mobile contact bridge bearing a first mobile monitoring contact and a second mobile monitoring contact, The first mobile control contact being arranged to cooperate with the first fixed contact and the first mobile monitoring contact being arranged to cooperate with the second fixed contact, The second mobile control contact being arranged to cooperate directly with the second mobile monitoring contact.

According to a particular feature, the first mobile contact bridge can be displaced in translation along a control axis between a closed first position and an open second position and its first mobile control contact can be in contact with the first fixed contact in the closed first position and away from the first fixed contact in the open second position.

According to another particular feature, the second mobile contact bridge can be displaced in translation along said control axis between an open first position and a closed second position and its first mobile monitoring contact can be away from the second fixed contact in the open first position and be in contact with the second fixed contact in the closed second position.

According to another particular feature, the second mobile monitoring contact and the second mobile control contact are arranged to be in contact when the first mobile contact bridge is in its closed first position and the second mobile contact bridge is in its closed second position.

According to another particular feature, from its open position to its closed position, the first mobile contact bridge can be displaced in translation along said control axis in a first direction and from its open position to its closed position, the second mobile contact bridge is displaced along said control axis, in a second direction which is opposite to said first direction.

According to another particular feature, the switching assembly comprises a first abutment produced on the body and arranged to cooperate with the first mobile contact bridge in its closed first position, this first abutment being positioned off-centre relative to the median axis of translation of the first mobile contact bridge and opposite its first mobile control contact relative to said axis.

According to another particular feature, the switching assembly comprises a second abutment produced on the housing and arranged to cooperate with the second mobile contact bridge in its closed first position, this second abutment being positioned off-centre relative to the median axis of translation of the second mobile contact bridge (41) and opposite its first mobile monitoring contact (42*a*) relative to said axis.

According to another particular feature, the first mobile contact bridge is mounted by runner link on the control pushbutton and the switching assembly comprises a first contact pressure spring arranged between the control pushbutton and the first mobile contact bridge.

According to another particular feature, the switching assembly comprises a closure spring arranged between the body and the control pushbutton.

According to another particular feature, the second mobile contact bridge is mounted by runner link on the monitoring pushbutton and the switching assembly comprises a second contact pressure spring arranged between the monitoring pushbutton and the second mobile contact bridge.

According to another particular feature, the switching assembly comprises an opening spring arranged between the body and the monitoring pushbutton.

The invention relates also to a switching device comprising a control assembly comprising an actuation member that can take an idle position and an actuation position, said switching device comprising a switching assembly as defined above.

BRIEF DESCRIPTION OF THE FIGURES

Other features and advantages will emerge from the following detailed description, given with respect to the attached drawings in which.

DETAILED DESCRIPTION OF AT LEAST ONE EMBODIMENT

Figure 1A:
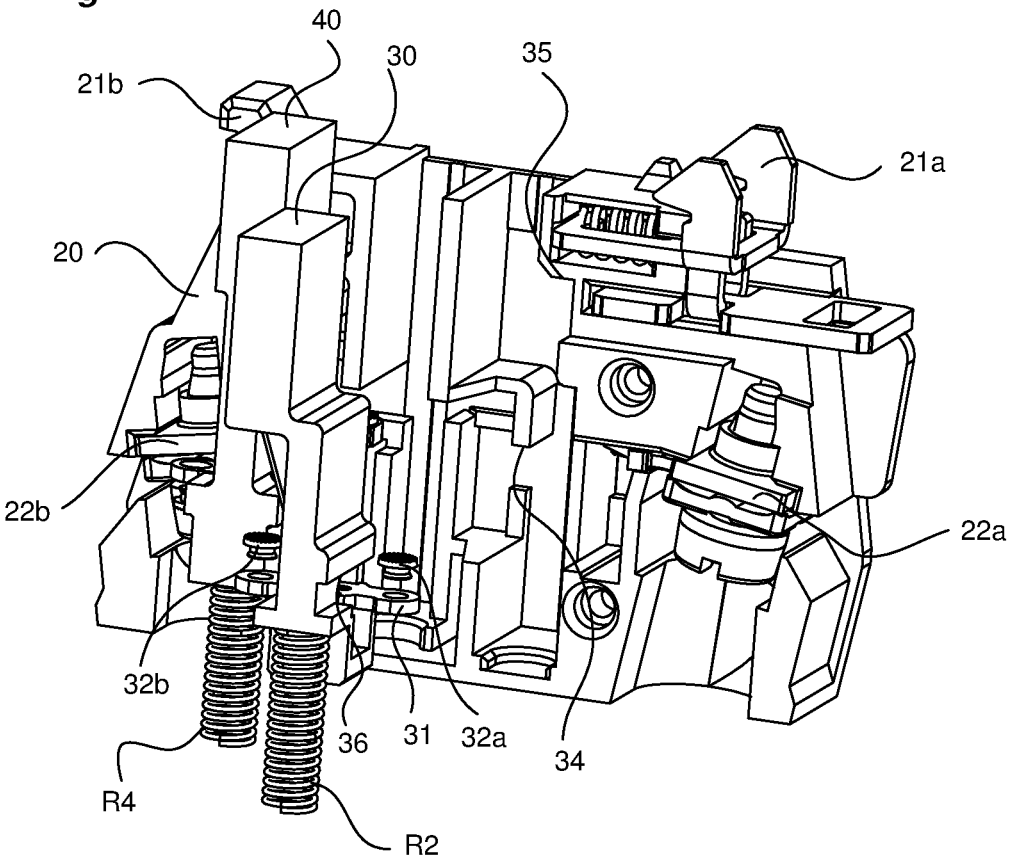
FIGS. 1A and 1B represent, from two different viewing angles and partially exploded, the internal part of the switching assembly of the invention.
Figure 1B:
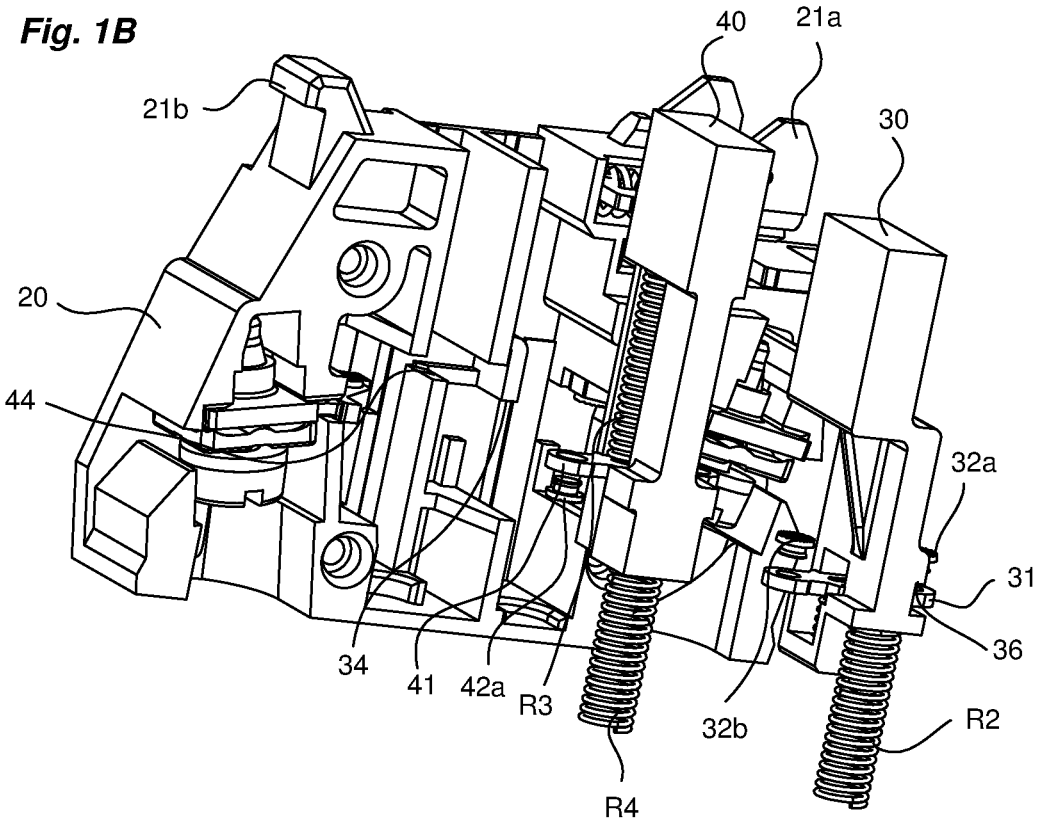

As is known, a device of emergency stop type, also called palm switch, comprises two distinct assemblies 1, 2 formed by a control assembly, also designated first assembly 1, and a switching assembly, also designated second assembly 2.

The first assembly 1 (visible in FIG. 5) comprises an actuation member 10 intended to be depressed in case of emergency by the operator along a control axis (X) to open an electrical circuit. The actuation member 10 can thus take an idle position, in which it is not depressed, leaving the electrical circuit closed, and an actuation position in which it is depressed to open the electrical circuit.

The second assembly 2 is a contact block intended to control the electrical circuit. The latter is represented in the attached FIGS. 1A to 5. This second assembly 2 comprises a body or housing 20, for example made of plastic material, comprising means 21*a*, 21*b* of attachment to the first assembly 1. According to the invention, the second assembly 2 comprises a control switch making it possible to control the electrical circuit according to the position of the actuation member 10. It also comprises a monitoring switch that makes it possible to monitor the correct attachment of the second assembly 2 to the first assembly 1 by keeping the electrical circuit open as long as the first assembly 1 is disconnected mechanically from the second assembly 2.

The second assembly 2 comprises a first contact terminal 22*a* and a second contact terminal 22*b*. It comprises a first fixed contact 23*a* linked electrically to its first terminal 22*a* and a second fixed contact 23*b* linked electrically to its second terminal 22*b*. The two terminals are for example conventional screw terminals.

The control switch comprises a control pushbutton 30 that can be actuated in translation along the axis (X) and a first mobile contact bridge 31 bearing a first set of two mobile so-called control contacts 32*a*, 32*b*, said bridge 31 being mounted by runner link on the control pushbutton 30. It also comprises a contact pressure spring R1 mounted between an abutment 33 of the control pushbutton 30 and the first mobile contact bridge 31. It also comprises a closure spring R2 mounted in a recess along the axis (X) between the control pushbutton 30 and the body 20 of the switching assembly 2. The closure spring R2 and the contact pressure spring R1 are of helical type and have their axis oriented along the axis (X).

The monitoring switch comprises a monitoring pushbutton 40 that can be actuated in translation along the axis (X) and a second mobile contact bridge 41 bearing a second set of two mobile so-called monitoring contacts 42*a*, 42*b*, said second mobile contact bridge 41 being mounted by runner link on the monitoring pushbutton. It comprises a contact pressure spring R3 mounted along the axis (X) between an abutment 43 of the monitoring pushbutton 40 and the mobile contact bridge 41. It also comprises an opening spring R4 mounted in a recess along the axis (X) between the monitoring pushbutton 40 and the body 20 of the switching assembly. The contact pressure spring R3 and the opening spring R4 are of helical type and have their axis oriented along the axis (X).

The first mobile contact bridge 31 can be displaced in translation between a closed first position and an open second position. It bears a first mobile control contact 32*a* arranged to cooperate with the first fixed contact 23*a* and a second mobile control contact 32*b*.

The second mobile contact bridge 41 can also be displaced in translation between an open first position and a closed second position. It bears a first mobile monitoring contact 42*a* arranged to cooperate with the second fixed contact 23*b* and a second mobile monitoring contact 42*b*.

The first mobile contact bridge 31 and the second mobile contact bridge 41 are produced in a metal material and make it possible to produce an electrical link between their two mobile contacts.

The solution of the invention offers the particular feature that the second mobile control contact 32*b* is arranged to cooperate with the second mobile monitoring contact 42*b*. Thus, when the first mobile contact bridge 31 and the second mobile contact bridge 41 are in their respective closed positions, the second mobile control contact 32*b* and the second mobile monitoring contact 42*b* are in contact, thus closing the electrical circuit.

The cooperation of the two mobile contacts requires a reverse actuation of the first mobile contact bridge 31 and of the second mobile contact bridge 41.

In other words, from its open position to its closed position, the first mobile contact bridge 31 is displaced along the axis (X) in one direction and, from its open position to its closed position, the second mobile contact bridge 41 is displaced along the axis (X), but in the opposite direction. Likewise, the first fixed contact 23*a* and the second fixed contact 23*b* each have their contact face oriented in opposite directions to each cooperate respectively with the first mobile control contact 32*a* and with the first mobile monitoring contact 42*a*.

The second assembly 2 also comprises a first abutment 34 produced on the body 20 and arranged to cooperate with the first mobile contact bridge 31. This first abutment 34 is positioned off-centre relative to the median translation axis of the first mobile contact bridge 31 and opposite its first mobile control contact 32*a* relative to this axis, so as to keep the bridge 31 in its axis when it is in closed position and the second mobile contact bridge 41 is then in open position.

The second assembly 2 comprises a second abutment 44 produced on the body 20 and arranged to cooperate with the second mobile contact bridge 41. This second abutment 44 makes it possible to block the second mobile contact bridge 41 in translation when the latter comes into its closed position. This second abutment 44 is positioned off-centre relative to the median translation axis of the second mobile contact bridge 41 and opposite its first mobile monitoring contact 42*a* relative to said axis, so as to keep the bridge 41 in its axis when it is in closed position and avoid misaligning the contact established between the second mobile control contact 32*b* and the second mobile monitoring contact 42*b*.

Figure 2A:
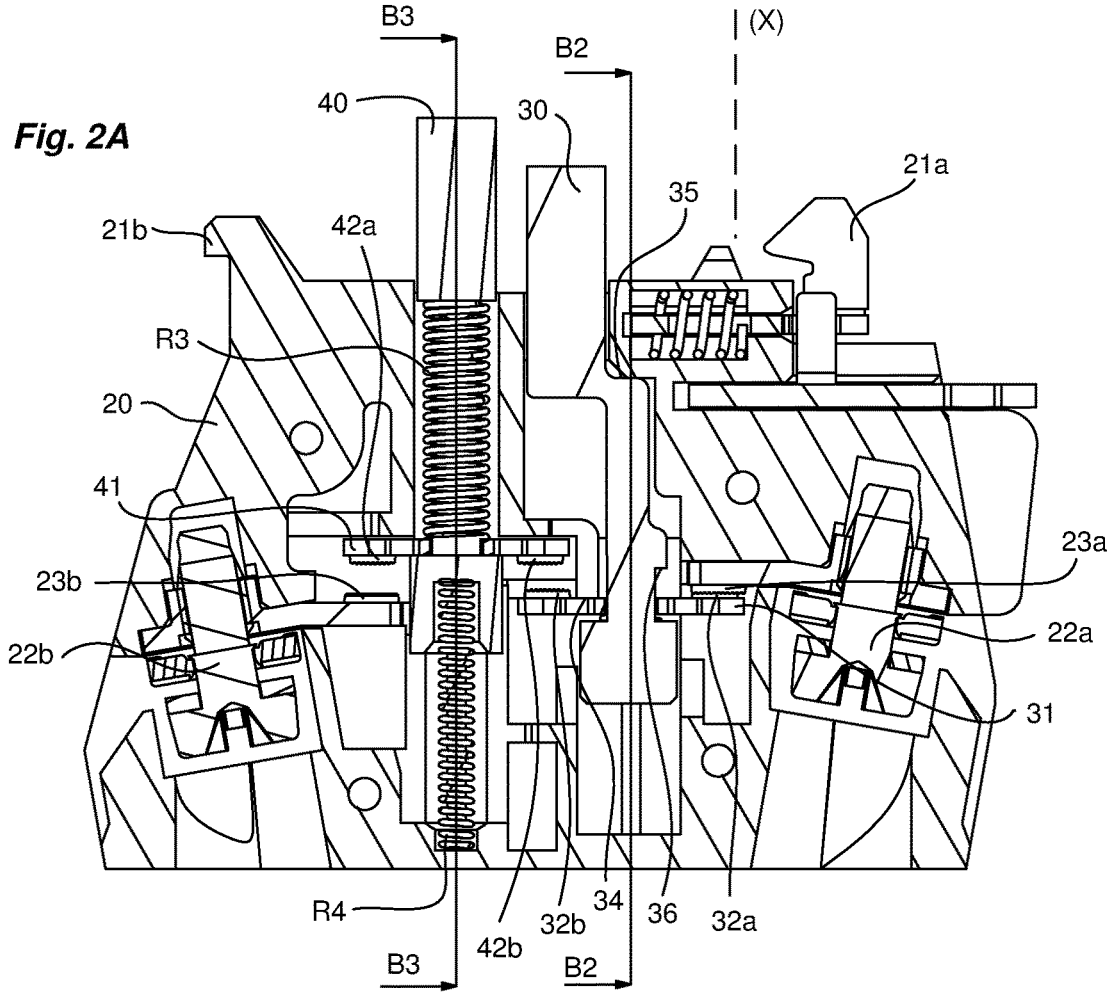
FIGS. 2A, 2B and 2C represent the switching assembly of the invention, in a so-called free position, that is to say with the control assembly absent.
Figure 2B:
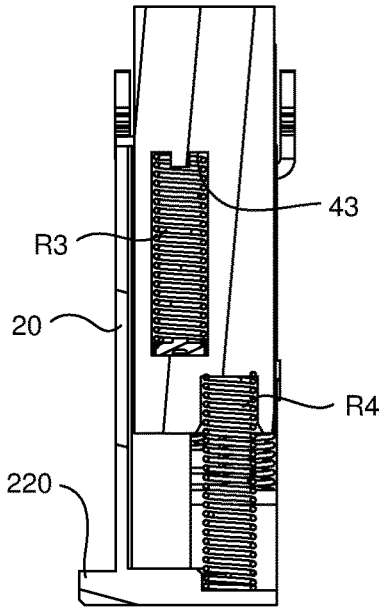
Figure 2C:
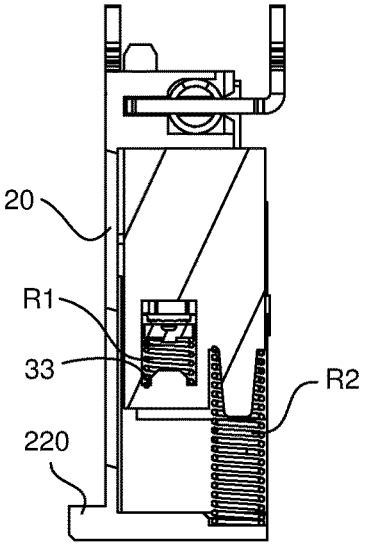

Starting from this architecture, the principle of operation of the device is described hereinbelow in more detail in conjunction with FIGS. 2A to 5:

FIGS. 2A to 2C—First State of Operation

The switching assembly 2 and the control assembly 1 are separated.

The control pushbutton 30 is in its closed position and the monitoring pushbutton 40 is in its open position.

The head of the monitoring pushbutton 40 is offset upwards relative to the head of the control pushbutton 30.

The first mobile monitoring contact 42*a* of the second mobile contact bridge 41 is not therefore connected to the second fixed contact 23*b* and its second mobile monitoring contact 42*b* is not connected to the second mobile control contact 32*b* of the first mobile contact bridge 31.

The electrical circuit is therefore open.

In this state, stressed by the closure spring R2, the control pushbutton 30 comes to bear against an abutment 35 of the housing 20 and the first mobile contact bridge 31 is bearing against the first abutment 34 defined above, making it possible to stress the contact pressure spring R1 arranged between the first mobile contact bridge 31 and the control pushbutton 30. The first abutment 34 can be positioned on the housing to allow a slight rotation of the first mobile contact bridge 31 in the clockwise direction.

Figure 3A:
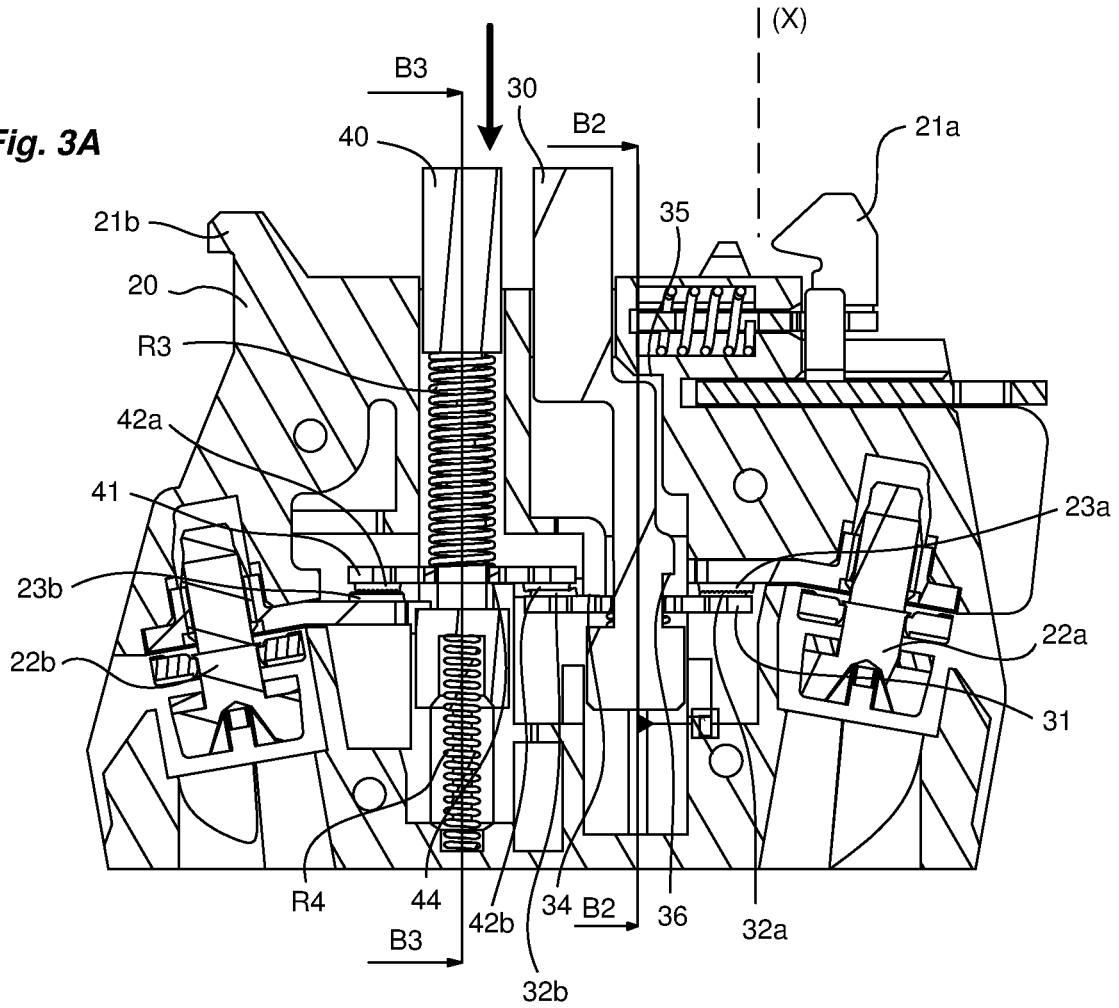
FIGS. 3A, 3B and 3C represent the switching assembly of the invention, in a so-called operational position, that is to say with the control assembly mounted on the switching assembly.
Figure 3B:
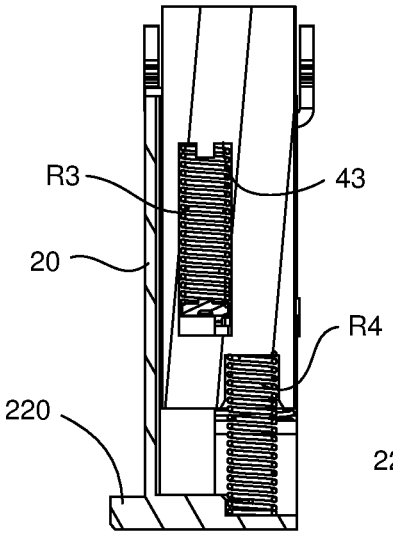
Figure 3C:
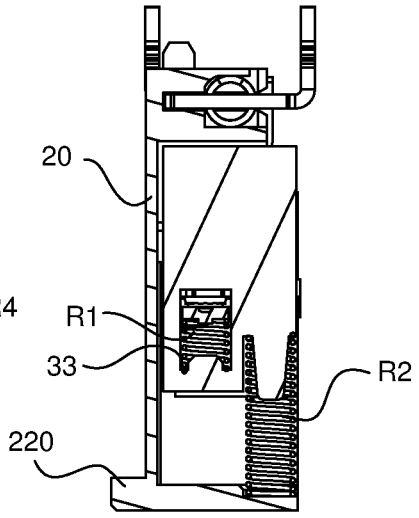

FIGS. 3A to 3C—Second State of Operation

The control assembly 1 (not represented) is attached to the switching assembly 2.

The attachment causes the translation of the monitoring pushbutton 40 from its open position to its closed position and forms a top upper abutment for the monitoring pushbutton 40.

In closed position, the first mobile monitoring contact 42*a* comes into contact with the second fixed contact 23*b* and the second mobile monitoring contact 42*b* comes into contact with the second mobile control contact 32*b*.

The opening spring R4 is thus stressed in compression upon the translation of the monitoring pushbutton 40. The contact pressure spring R3 is also stressed in compression, making it possible to apply a contact pressure of the first mobile monitoring contact 42*a* against the second fixed contact 23*b* and of the second mobile contact bridge 41 against the second abutment 44.

A translation of the control pushbutton 30 occurs also, freeing it from its abutment 35, this translation being absorbed by the closure spring R2. The first mobile contact bridge 31 remains in its closed position under the action of the contact pressure spring R1.

The second abutment 44 is positioned to meet a sufficient contact pressure between the second mobile monitoring contact 42*b* and the second mobile control contact 32*b* when the two bridges 31, 41 are in closed position.

In this state, the contact pressure applied by each contact pressure spring R1, R3 at these two mobile contacts 32*b*, 42*b* makes it possible to compensate for the slight rotation of the first mobile contact bridge 31 (slight rotation present in the absence of the control assembly—see above) and to restore the latter to the axis.

The electrical circuit is therefore closed and the switching device formed by the joining of the control assembly 1 onto the switching assembly 2 is operational.

Figure 4A:
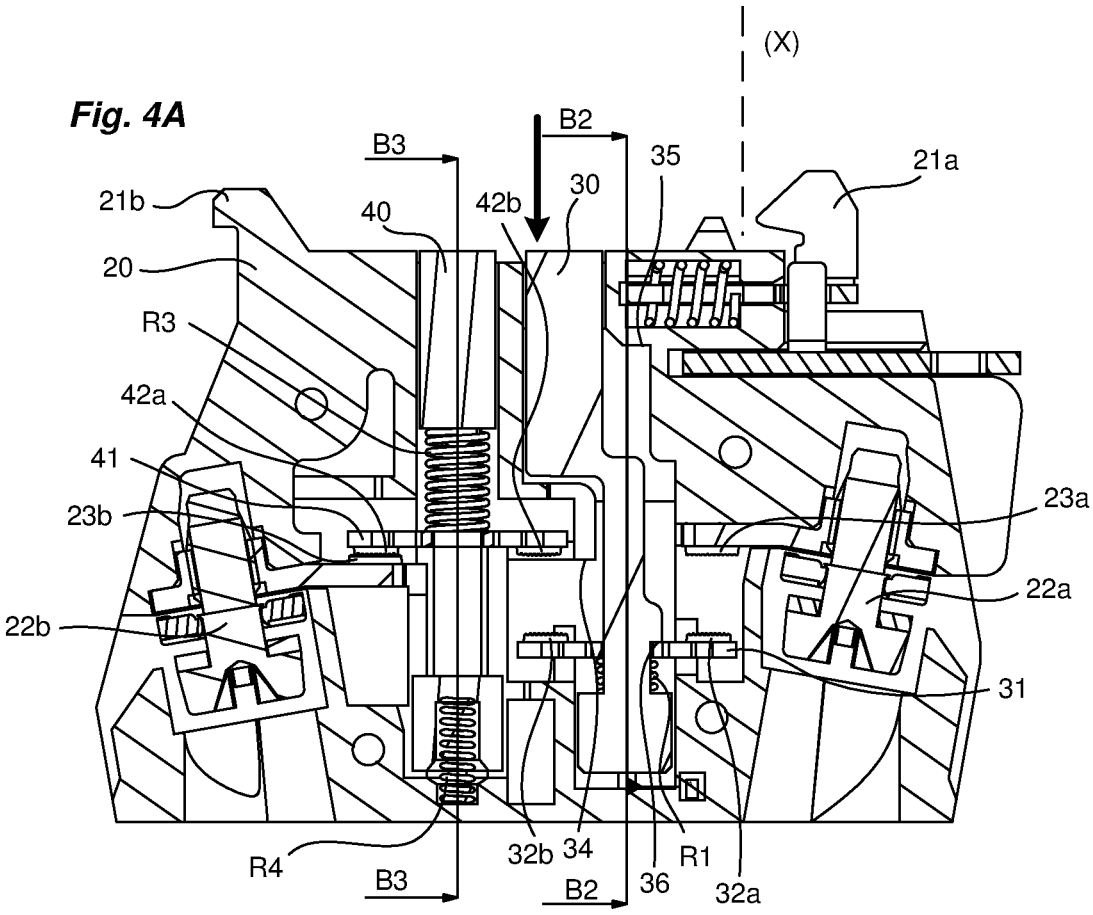
FIGS. 4A, 4B and 4C represent the switching assembly of the invention, in a so-called actuated operational position, that is to say with the control assembly mounted and control head actuated.
Figure 4B:
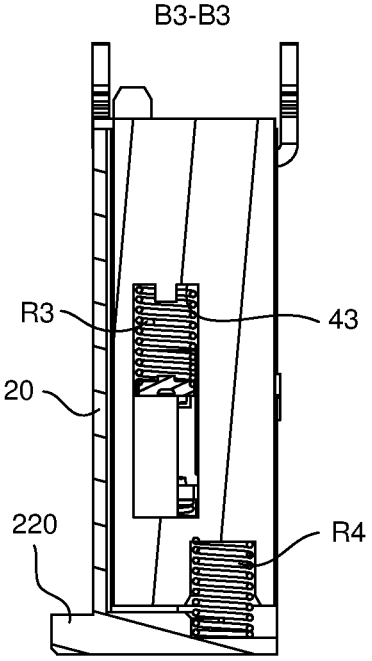
Figure 4C:
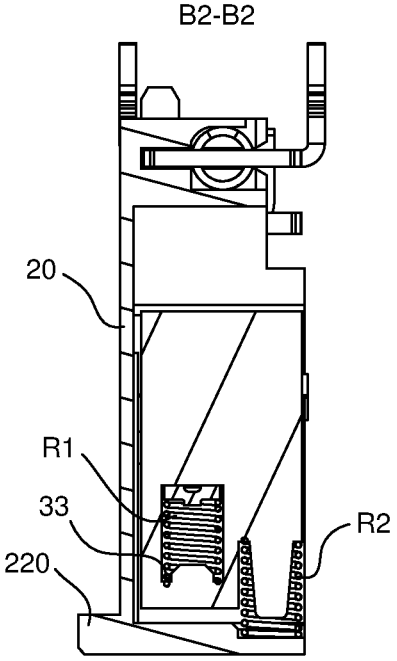

FIGS. 4A to 4C—Third State of Operation

The actuation member 10, that is to say the emergency stop head, is actuated. In actuated position, the actuation member 10 forms a bottom upper abutment for the two pushbuttons.

The actuation of the head therefore causes both the translation of the control pushbutton 30 and the translation of the monitoring pushbutton 40.

Since the second mobile contact bridge 41 is in closed position and blocked in translation by the second abutment 44, said bridge cannot be translated. The translation of the monitoring pushbutton 40 is therefore absorbed by the opening spring R4 and by the contact pressure spring R3.

In its translational movement, the control pushbutton 30 causes, by virtue of an abutment 36 produced on its stem, the translation of the first mobile contact bridge 31 from its closed position to its open position. The translation of the control pushbutton 30 is made possible by compression of the closure spring R2, causing the release of the contact pressure spring R1 and the return of the first mobile contact bridge 31 against said abutment 36. The first mobile control contact 32*a* is then away from the first fixed contact 23*a* and the second mobile control contact 32*b* is away from the second mobile monitoring contact 42*b*, thus causing the opening of the electrical circuit.

Figure 5:
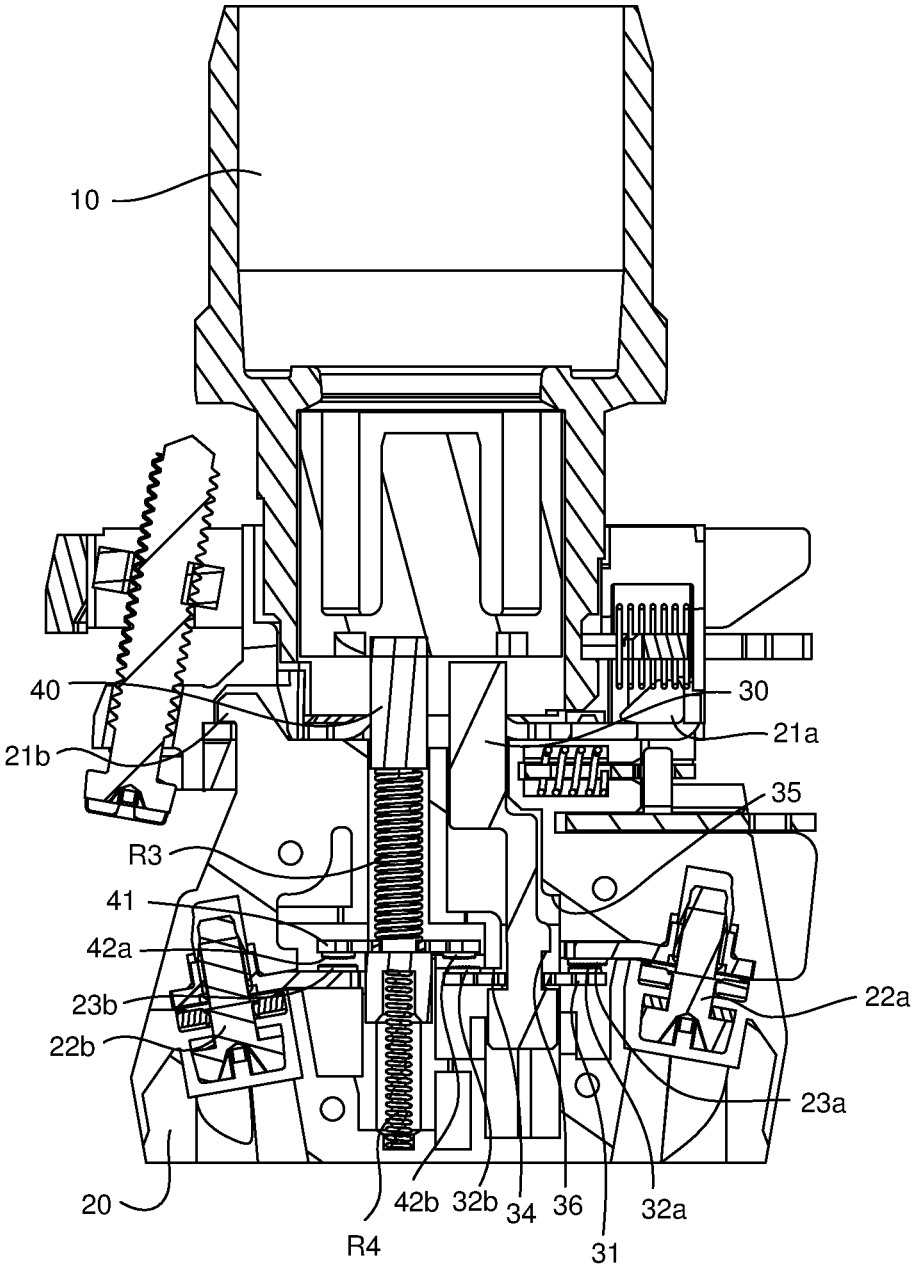
FIG. 5 represents the switching device of the invention, in a so-called non-operational position, corresponding to a malfunctioning mechanical association between control assembly and switching assembly.

FIG. 5—Fourth State of Operation

This FIG. 5 illustrates the operation of the invention when the control assembly 1 is badly attached to the switching assembly 2.

In this situation, the monitoring pushbutton 40 can thus be in an intermediate position situated between its position corresponding to the control assembly 1 not being attached (FIGS. 2A to 2C) and its position corresponding to the control assembly 1 being attached operationally (FIGS. 3A to 3C). In this intermediate position, the translation of the monitoring pushbutton 40 is made possible by compression of the opening spring R4 but it is insufficient to drive the second mobile contact bridge 41 to its closed position. The electrical circuit then remains open, as long as the mechanical attachment is not correctly made between the two assemblies, which makes it possible to guarantee a high level of safety.

In case of complete ejection of the control assembly 1 relative to the switching assembly, that is to say in case of complete detachment of the head, the device reverts automatically to the first state of operation described above. In this situation, since the control assembly is no longer in any way attached to the switching assembly, the monitoring pushbutton 40 reverts to its initial position, stressed by the two springs R3 and R4.

Moreover, it can be noted that when the switching device is provided with multiple adjacent switching assemblies, the so-called main switching assembly, corresponding to that of the invention described above, can be provided with mechanical means capable of acting on each adjacent switching assembly to ensure their operational mechanical attachment. The aim is thus to secure the attachment of at least one other switching assembly using the main switching assembly whose attachment is already monitored by virtue of the solution of the invention described above. According to the invention, the main switching assembly 2 therefore makes it possible to secure the joining of one or two auxiliary switching assemblies onto the control assembly 1. For that, each auxiliary switching assembly must be positioned adjacent to the main switching assembly 2. If the device comprises two auxiliary switching assemblies, these assemblies must be positioned on either side of the main switching assembly 2.

These mechanical securing means can comprise a protruding part produced on the housing 20 of the assembly and cooperating with a rear face of the adjacent auxiliary switching assembly when the main switching assembly 2 is attached mechanically to the control assembly 1. This protruding part can consist of a fin 220 produced at right angles to the main axis. It is visible in the attached figures.

It will be understood from the above that the invention offers many advantages, for example:

- It makes it possible to keep the electrical circuit open and the device non-operational, as long as the mechanical attachment between the two assemblies is not correctly made;
- It offers simple and reliable operation, involving a minimum of additional components;
- It offers a particularly limited bulk, because the two contact bridges are connected directly in series, via the two central contacts;
- It also offers a solution that makes it possible to monitor the mechanical attachment of the adjacent blocks.

The invention claimed is:

1. Switching assembly configured to be joined onto a control assembly provided with an actuation member configured to have an idle position and an actuation position, said switching assembly comprising:

a body, an electrical circuit comprising a first fixed contact and a second fixed contact, said electrical circuit being able to be controlled both by a control switch of normally-closed type comprising a first mobile contact bridge bearing a first mobile control contact and a second mobile control contact and by a monitoring switch of normally-open type, linked in series with said control switch and comprising a second mobile contact bridge bearing a first mobile monitoring contact and a second mobile monitoring contact, wherein:

the first mobile control contact is arranged to make physical contact with the first fixed contact and the first mobile monitoring contact is arranged to make physical contact with the second fixed contact, and the second mobile control contact is arranged to make physical contact with the second mobile monitoring contact.

2. Switching assembly according to claim 1, wherein the first mobile contact bridge can be displaced in translation along a control axis between a closed first position and an open second position and wherein the first mobile control contact can be in contact with the first fixed contact in the closed first position and away from the first fixed contact in the open second position.

3. Switching assembly according to claim 2, wherein the second mobile contact bridge can be displaced in translation along said control axis between an open first position and a closed second position and wherein the first mobile monitoring contact can be away from the second fixed contact in the open first position and be in contact with the second fixed contact in the closed second position.

4. Switching assembly according to claim 3, wherein the second mobile monitoring contact and the second mobile control contact are arranged to be in contact when the first mobile contact bridge is in the closed first position and the second mobile contact bridge is in the closed second position.

5. Switching assembly according to claim 4, wherein, from the open second position to the closed first position, the first mobile contact bridge can be displaced in translation along said control axis in a first direction and wherein, from the open first position to the closed second position, the second mobile contact bridge is displaced along said control axis, in a second direction which is opposite to said first direction.

6. Switching assembly according to claim 3, wherein the switching assembly comprises a first abutment produced on the body and arranged to cooperate with the first mobile contact bridge in the closed first position, the first abutment being positioned off-center relative to a median axis of translation of the first mobile contact bridge and opposite the first mobile control contact relative to the median axis of translation of the first mobile contact bridge.

7. Switching assembly according to claim 6, wherein the switching assembly comprises a second abutment produced on the body and arranged to cooperate with the second mobile contact bridge in the closed second position, the second abutment being positioned off-center relative to a median axis of translation of the second mobile contact bridge and opposite the first mobile monitoring contact relative to the median axis of translation of the second mobile contact bridge.

8. Switching assembly according to claim 1, wherein the first mobile contact bridge is mounted by runner link on a control pushbutton and wherein the switching assembly comprises a first contact pressure spring arranged between the control pushbutton and the first mobile contact bridge.

9. Switching assembly according to claim 8, wherein the switching assembly comprises a closure spring arranged between the body and the control pushbutton.

10. Switching assembly according to claim 8, wherein the second mobile contact bridge is mounted by runner link on a monitoring pushbutton and wherein the switching assembly comprises a second contact pressure spring arranged between the monitoring pushbutton and the second mobile contact bridge.

11. Switching assembly according to claim 10, wherein the switching assembly comprises an opening spring arranged between the body and the monitoring pushbutton.

12. Switching device comprising a control assembly comprising an actuation member that can take an idle position and an actuation position, wherein the switching device comprises a switching assembly as defined in claim 1.

* * * * *